US011059250B2

(12) United States Patent
Ruf

(10) Patent No.: US 11,059,250 B2
(45) Date of Patent: Jul. 13, 2021

(54) PRESSING HEAD, DEVICE FOR PRESSING MATERIAL TO BE PRESSED, AND METHOD FOR PRESSING MATERIAL TO BE PRESSED

(71) Applicant: RUF MASCHINENBAU GMBH & CO. KG, Zaisertshofen (DE)

(72) Inventor: Hans Ruf, Zaisertshofen (DE)

(73) Assignee: RUF MASCHINENBAU GMBH & CO. KG, Zaisertshofen (DE)

( * ) Notice: Subject to any disclaimer, the term of this patent is extended or adjusted under 35 U.S.C. 154(b) by 0 days.

(21) Appl. No.: 16/467,237

(22) PCT Filed: Dec. 9, 2016

(86) PCT No.: PCT/EP2016/080432
§ 371 (c)(1),
(2) Date: Jun. 6, 2019

(87) PCT Pub. No.: WO2018/103860
PCT Pub. Date: Jun. 14, 2018

(65) Prior Publication Data

US 2019/0299555 A1 Oct. 3, 2019

(51) Int. Cl.
*B30B 11/22* (2006.01)
*B30B 11/26* (2006.01)

(52) U.S. Cl.
CPC ..... *B30B 11/225* (2013.01); *B30B 11/26* (2013.01)

(58) Field of Classification Search
CPC ..... B30B 11/225; B30B 11/26
See application file for complete search history.

(56) References Cited

U.S. PATENT DOCUMENTS 3,090,182 A 5/1963 Johnson et al.
3,304,592 A 2/1967 Fattirolli

FOREIGN PATENT DOCUMENTS

DE 260 831 C 2/1912
DE 1 627 914 A1 1/1971
WO WO-9414596 A1 * 7/1994 ..... B29C 48/022

OTHER PUBLICATIONS

International Search Report Corresponding to PCT/EP2016/080432 dated Sep. 29, 2017.
Written Opinion Corresponding to PCT/EP2016/080432 dated Sep. 29, 2017.

* cited by examiner

*Primary Examiner* — Joseph S Del Sole
*Assistant Examiner* — Yung-Sheng M Tsui
(74) *Attorney, Agent, or Firm* — Finch & Maloney, PLLC; Michael J. Bujold

(57) ABSTRACT

A pressing head (100) for a device for pressing material to be pressed, e.g., an extrusion press for pressing chips. The pressing head (100) comprises at least two pressing channels (1, 1'), each having an inlet opening (11, 11') and an outlet opening (12, 12'). Each pressing channel (1, 1') has a stationary supporting element (2, 2') and a movable pressing element (3, 3'). The pressing element (3, 3') is movable on one side, preferably relative to the supporting element (2, 2'). A cross-section (QA) of the pressing channel, at the outlet opening of the pressing channel, can be varied relative to the cross-section (QE) of the pressing channel, at the inlet opening of the pressing channel.

19 Claims, 5 Drawing Sheets

Figure 1:
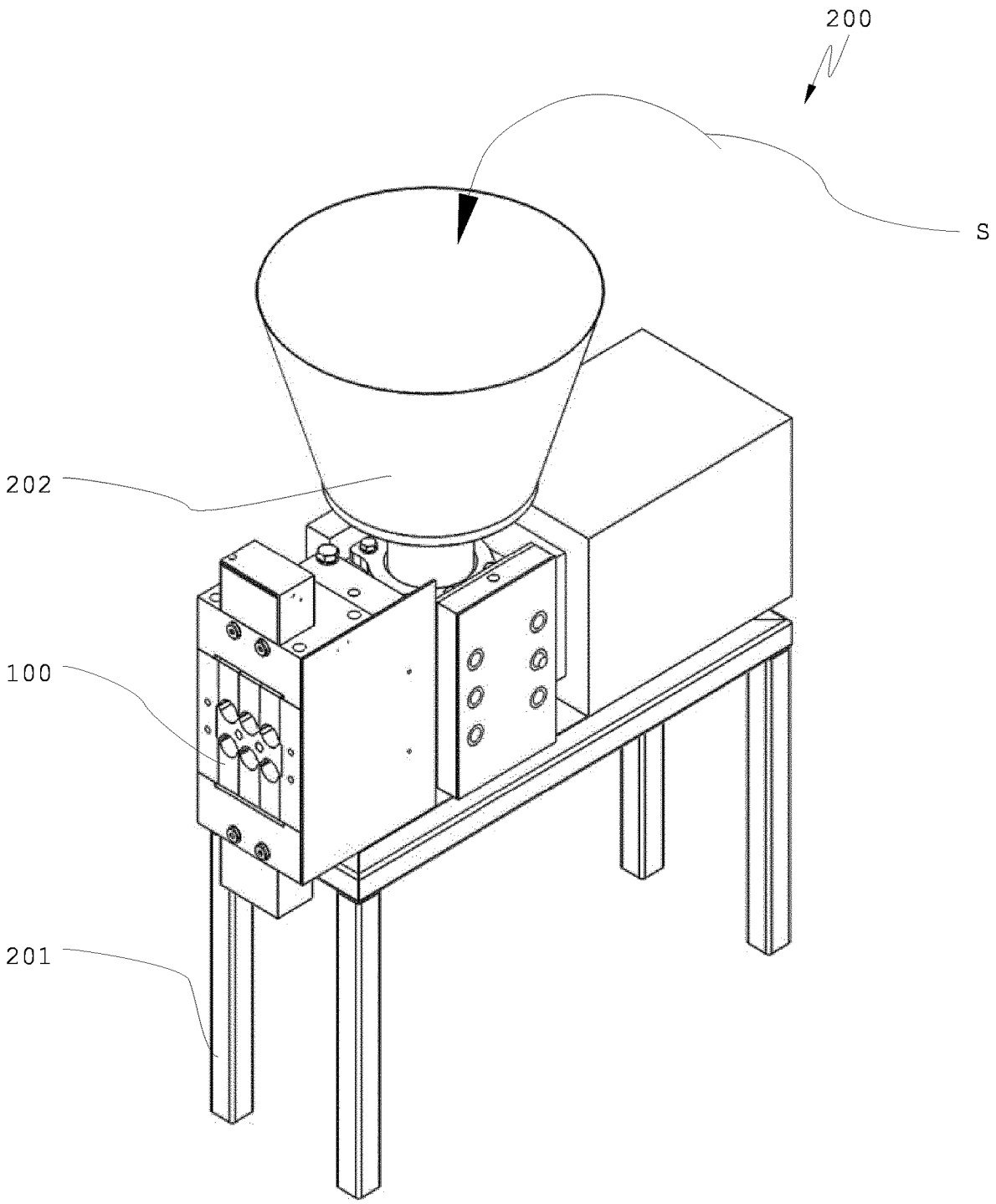

PRESSING HEAD, DEVICE FOR PRESSING MATERIAL TO BE PRESSED, AND METHOD FOR PRESSING MATERIAL TO BE PRESSED

The present invention relates to a pressing head, to an apparatus for pressing material to be pressed, and to a method for pressing material to be pressed in accordance with the preambles of the independent claims.

Waste materials in the form of chips arise during the machining of workpieces, in particular of workpieces made from metals. Depending on the machined material, an important link in the value chain is found in said chips. Firstly no raw materials are to be wasted, and secondly the raw materials, and in the present case the chips, are to be or can be reused.

It is known from the prior art to press said chips which arise, on one hand to reduce the volume. On the other hand, lubricants such as oils or the like and cooling fluid can thus be pressed out of the chips. Presses of this type are known to a person skilled in the art as briquetting presses. Briquetting presses are also used, in particular, for briquetting wood chips or also dry chaff such as chopped grass or hay.

A press of this type has been disclosed by DE1627914. DE1627914 discloses a pressing head having a pressing channel and a pressing element which is arranged movably in the pressing channel. The movable pressing element exerts a force on the material to be pressed which can be set by way of a screw spindle.

The apparatus from DE1627914 proves to be unsuitable for pressing material to be pressed which has a high inhomogeneity, as is present in the case of chips. Clover or grass clippings, for which the pressing head of DE1627914 is designed, are chopped homogeneously and have a homogeneous size distribution. Material to be pressed which arises, for example, during machining of workpieces has a high degree of inhomogeneity. This is due to, for example, the machining of the workpiece with different tools. Thus, for example, very large and very small chips can arise at the same time.

The pressing head from DE1627914 is equipped with a spring which exerts a constant static prestressing force on the pressing element. Said prestressing force can be set in advance by means of a setting screw, but then remains unchanged. A further disadvantage of this previously known apparatus is the limited quantity of material to be pressed which can be processed or pressed per stroke.

It is an object of the invention to overcome these and further disadvantages of the prior art.

This object is achieved by way of the apparatus and methods according to the independent patent claims.

Further embodiments result from the dependent patent claims.

A pressing head according to the invention for an apparatus for pressing material to be pressed and, in particular, for pressing chips, preferably an extrusion press, comprises at least two pressing channels. Each of the pressing channels has an inlet opening and an outlet opening. Each pressing channel has a, in particular stationary, supporting element and one movable pressing element each. The pressing element is movable on one side, preferably relative to the supporting element, and in particular in the region of the outlet opening, in such a way that a cross section of the pressing channel at its outlet opening is changeable relative to the cross section of the pressing channel at its inlet opening.

Preferably, the pressing head has a die which is arranged in front of the inlet opening of the pressing channel. The inlet opening of the pressing channel then coincides with an inlet opening of the die. Thus, the pressing channel comprises the die or its opening. The die has an opening for each pressing channel.

This allows for pressing of one briquette per pressing channel, i.e. at least two briquettes at the same time, wherein the cross section of each pressing channel is adjustable or changeable separately for each briquette.

The change of the cross section of the pressing channel at its outlet opening relative to the cross section of the pressing channel at its outlet opening enables a more or less pronounced clamping of a briquette situated in the pressing channel. During the pressing operation, the briquette naturally has a cross section which corresponds substantially to the cross section of the pressing channel at its inlet opening. Due to the inhomogeneity of the material to be pressed into a briquette, however, the briquettes are more or less elastic in their cross section, and thus, individual briquettes have a varying elasticity compared to one another.

Due to the changing of the cross section of the pressing channel, it is possible to exert a holding or clamping force on the briquette which is substantially constant independently of the nature of the briquette.

This ensures that a second briquette which is subsequently pressed in the pressing channel encounters a sufficiently high resistance by the first briquette. Thus, the quality of the following briquette can be improved. The cross section of the pressing channels can be adjusted individually for each pressing channel. The quality of the briquettes is, independently of the nature of the material to be pressed, substantially constantly at a high level.

Preferably, the pressing channels are formed in their cross section substantially in halves by way of the supporting element and the pressing element. It is conceivable that a gap is formed between the supporting element and the pressing element which does not have to be completely closed even in the case of a reduction of the cross section at the outlet opening.

Alternatively, it would likewise be conceivable that the cross-sectional area of the pressing channel is substantially halved by the supporting element and the pressing element, but that the pressing element only corresponds approximately to the diameter of the pressing channel and is configured as a push-in element on the press head which completes the cross section of the pressing channel.

The pressing channel has a longitudinal axis between its inlet opening and its outlet opening, and is open along said longitudinal axis, in a orthogonal direction to the longitudinal axis. That is to say, the inlet opening and the outlet opening are connected to one another by way of an open channel. The pressing element can be situated in said open channel, and can in particular be movably arranged therein.

Preferably, the pressing channels have a common supporting element. Said supporting element is preferably configured in one part, in particular integrally.

This enables, on one hand, simple manufacturing and, on the other hand an improvement of the force absorption. In addition, the common supporting element moves the pressing channels into a position relative to one another which is unchangeable.

Since the pressing channels have a separate pressing element each, inhomogeneous wear of the parts or regions of the respective pressing channels which are situated in the supporting element is not problematic. The holding force can be set independently for each pressing channel.

Alternatively, it would likewise be conceivable to provide a separate supporting element for each pressing channel, or to provide individual inserts on the supporting element.

In this way, it would be possible to only replace those parts or regions on the actuating element which exhibit proportionate wear, and to use other parts or regions for a longer time.

The pressing channels can be arranged next to one another in the pressing head.

This makes it possible to collect and to press the material to be pressed in a section which is wider in comparison with the prior art. Additionally, this facilitates the manufacturing of the pressing head. A common supporting element thus has to be machined only on one side, for example. The pressing elements can likewise be arranged next to one another. They can have common attachment elements.

Alternatively, it is conceivable that the pressing channels are arranged opposite to one another. This means that the pressing channels lie in a common plane, have a common pressing direction, but the pressing elements are arranged diametrically or opposite to one another.

Here, "arranged next to one another" means that the pressing channels lie in a first plane, and the pressing elements lie in a second plane which is parallel to said first plane.

Pressing channels arranged opposite to one another result in the advantage that the reaction force on the supporting element, which arises when the pressing element exerts a force on the briquettes, is provided by the respective opposite pressing element. Thus, in an ideal pressing operation, the supporting element would in principle be situated in a force-neutral position. Although an ideal force distribution of this type does of course not occur in practice, but the forces on the supporting element in case of simultaneous actuation of the pressing elements can at least be reduced.

The pressing head is preferably configured in such a way that each pressing element is mounted such that it can be pivoted about a rotational axis, preferably a rotational axis which is fixed with respect to the supporting element. This axis is situated, in particular, in the region of the inlet opening of the pressing channel. The rotational axis is arranged substantially at orthogonally with respect to the pressing channel. This means that the rotational axis is situated in a plane parallel to a plane through the longitudinal axis of the pressing channel, and has a direction which is at orthogonal with respect to the longitudinal axis of the pressing channel. In the case of a plurality of pressing channels, the plane is defined through the plurality of longitudinal axes of the respective pressing channels.

Each pressing element can be assigned an actuating element for adjusting the pressing element. This enables the adjustment of the pressing or holding force on each pressing element.

Each actuating element can preferably be adjusted independently and, in particular, can likewise be actuated independently.

Therefore, as set out herein, the pressing force can be adjusted independently in each pressing channel. This allows for influencing the briquette during the pressing operation. The actuating elements can be configured, for example, as hydraulic or pneumatic elements. It is likewise conceivable to provide a spring. Electric or mechanical actuating elements are likewise conceivable.

Preferably, three pressing channels are arranged next to one another. However, more than three pressing channels next to one another are also conceivable.

This increases the capacity of the pressing head.

It is likewise conceivable that two pairs of pressing channels are arranged opposite to one another. Preferably, three pressing channels each are arranged opposite to one another.

It is also conceivable, however, that more than three pressing channels are arranged opposite to one another.

An uneven number of pressing channels which are arranged opposite to one another is also conceivable; for example, three pressing channels can be situated on one side and two pressing channels can be situated on the other side. Further combinations are conceivable.

In this way, a pressing head can be adjusted individually to an associated pressing apparatus or to the associated material to be pressed. This can be advantageous, for example, if the material to be pressed is known during project development and said material has, for example, a defined distribution or size or a defined mixture of material to be pressed, for example large and small chips. If, for example, the pressing channels are arranged opposite to one another in a falling direction of the material to be pressed, presumably relatively small chips will collect in a lower region of the apparatus and relatively large chips will tend to collect in an upper region. Thus, it can be advantageous if, for example, two pressing channels are arranged in the lower region and three pressing channels are arranged in the upper region. A desired compression can thus be achieved if necessary.

A further aspect of the invention therefore also relates to an apparatus for pressing material to be pressed, in particular for pressing chips and, in particular, an extrusion press, the apparatus for pressing material to be pressed comprising at least one pressing head as described herein.

The advantages of such an apparatus have already been described herein.

Preferably, the apparatus comprises a pressing head as described herein, each pressing element being assigned an actuating element for adjusting the pressing element. The apparatus further comprises a control for adjusting the actuating element.

This enables the individual setting of the apparatus and, in particular, the pressing channels and also the independent operation of the apparatus.

Advantageously, each pressing channel is assigned a pressing plunger for pressing the material to be pressed.

This enables and simplifies the maintenance of the apparatus and, in particular, the maintenance of the pressing head.

In a preferred embodiment, the pressing plungers can be movable by means of a common cylinder.

In this way, a plurality of briquettes can be manufactured or pressed at the same time by way of a single pressing stroke of the cylinder.

As a result, the construction or the manufacturing of the apparatus is simplified and facilitated.

It would also be conceivable, however, to provide a plurality of cylinders which actuate different groups of pressing plungers. In this way, for example, an alternating operation of the pressing plungers would be conceivable. In addition, it would be possible to reduce the respective forces on the cylinders.

The apparatus as described in the present case can comprise a pre-collecting chamber for receiving and/or for pre-compacting material to be pressed. The pre-collecting chamber is preferably assigned to all pressing channels simultaneously.

Typically, an apparatus for pressing material to be pressed has a filling apparatus which is typically configured as a funnel.

The material to be pressed is typically collected in the funnel and is conducted to the pressing head. The material to be pressed can be conveyed to the pressing head, for example, merely through gravity.

Alternatively or additionally, further elements which convey the material to be pressed are conceivable, such as screw conveyors or the like. Typically, at least one mechanical conveying element is situated within the funnel in connection to the pressing head, ensuring that there is always sufficient material for pressing.

Preferably, a screw conveyor of this type opens into a pre-collecting chamber which receives the material to be pressed before the pressing. As a result of the coercive conveying of the screw conveyor, a pre-compression of the material to be pressed can occur.

The material to be pressed is pressed out of the pre-collecting chamber into briquettes and is collected, for example, in a recess for further processing.

Here, the apparatus can be configured as another constituent part of a further machine, such as a machining center. A separate configuration is likewise conceivable. Here, the apparatus can have additional elements for installation, such as a machine frame.

A further aspect of the invention relates to a method for pressing material to be pressed, in particular with an apparatus as described herein and preferably by way of a pressing head as described herein.

The method comprises the steps:

- feeding of material to be pressed, the material to be pressed preferably being added in a pre-collecting chamber.
- Pressing of a first portion of the material to be pressed through a pressing channel by way of a first pressing stroke from a starting position by a forward movement in the direction of a longitudinal axis of the pressing channel of a pressing plunger, preferably to an end position of the pressing plunger.
- Holding of the first pressed portion of the material to be pressed in the pressing channel by a movable pressing element.
- Return movement of the pressing plunger into the starting position.
- Feeding of a second portion of material to be pressed.
- Pressing of the second portion of the material to be pressed by way of a second pressing stroke of the pressing plunger.

The pressing force on the second portion of the material to be pressed is adjusted by the movable pressing element, in particular by way of a holding force of the first portion of the material to be pressed in the pressing channel.

The material to be pressed is preferably pressed simultaneously through two or more pressing channels; preferably through an arrangement of pressing channels as described herein.

The starting position corresponds to the position of the pressing plungers in the retracted state when the pressing plunger releases the pre-collecting chamber or is situated in its position which is the farthest away possible from the inlet opening of the pressing channel. The end position of the pressing plunger can be defined, on one hand, when a defined distance has been covered which is determined, for example, via a measurement at the cylinder or pressing plunger. It would likewise be conceivable that the end position is coupled to a defined force being reached.

The method can subsequently be repeated, the formerly second portion becoming the first portion in the process. In practice, this equilibrium between the first and the second portion is only reached after a few cycles of the method. The first cycles can therefore be seen as starting up until a stable state is reached.

This method enables, however, to achieve a high degree of quality of the briquettes and likewise a high consistency of the quality of the briquettes.

This method makes it possible, in the case of a plurality of pressing channels which are arranged next to one another or above one another, to achieve a equivalent quality of the briquettes which are pressed for each respective pressing channel.

Preferably, an actuating element for adjusting the holding force in dependence of an actuating variable at the pressing cylinder or at the pressing plunger is adjusted independently for each pressing element.

This enables individual quality control for each pressing channel.

Preferably, the actuating variable is defined in dependence of a force at the pressing plunger. The force at the pressing plunger is a direct indicator for the nature of the briquette and allows a clear statement about the pressing operation.

For example, devices similar to force-measuring strips and that provide a value for the definition of the actuating variable can be attached to the pressing plunger.

The pressing plungers are preferably operated hydraulically. The actuating variable can be defined in dependence of the hydraulic pressure.

Figure 2:
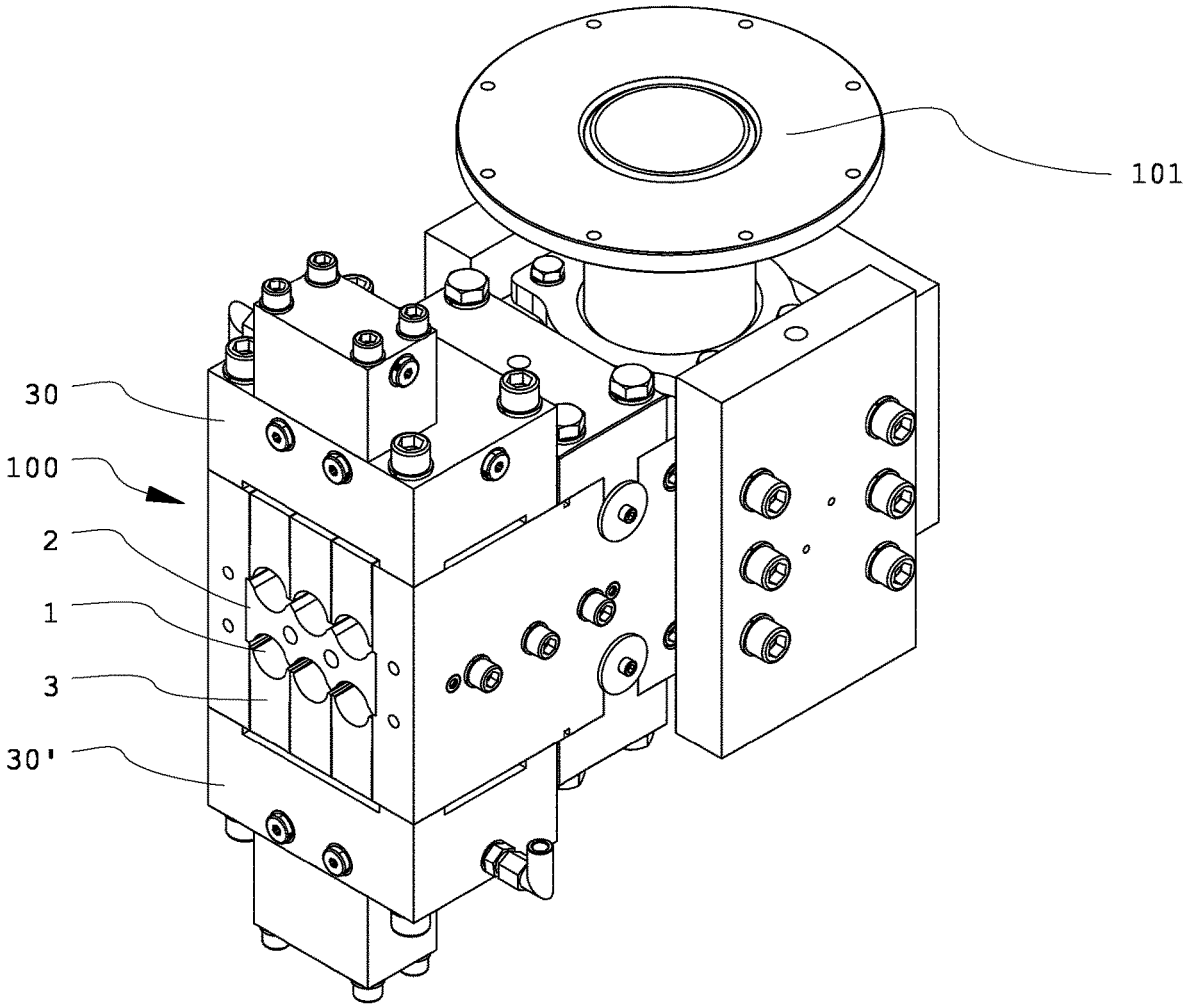
Figure 3:
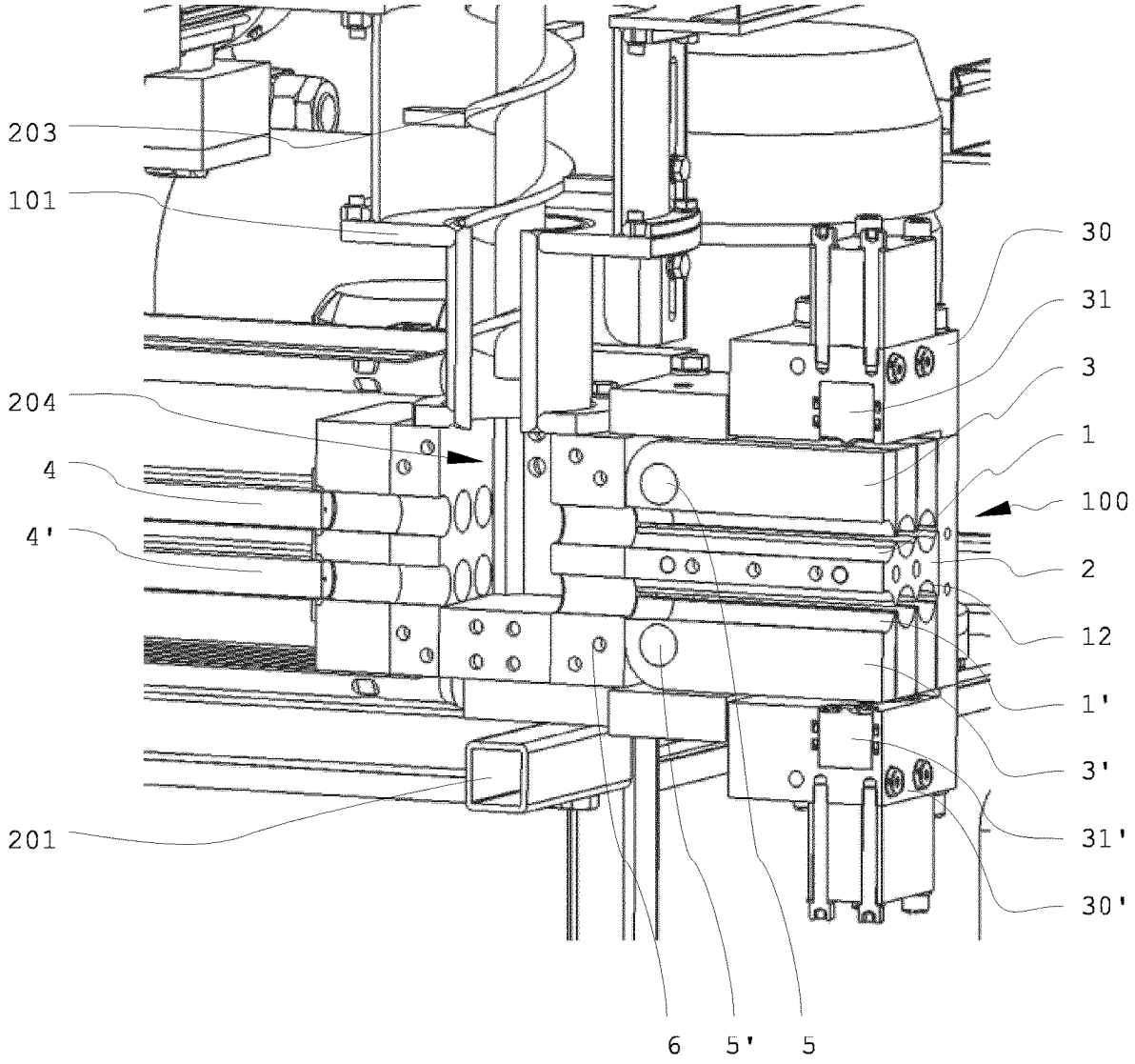
Figure 4:
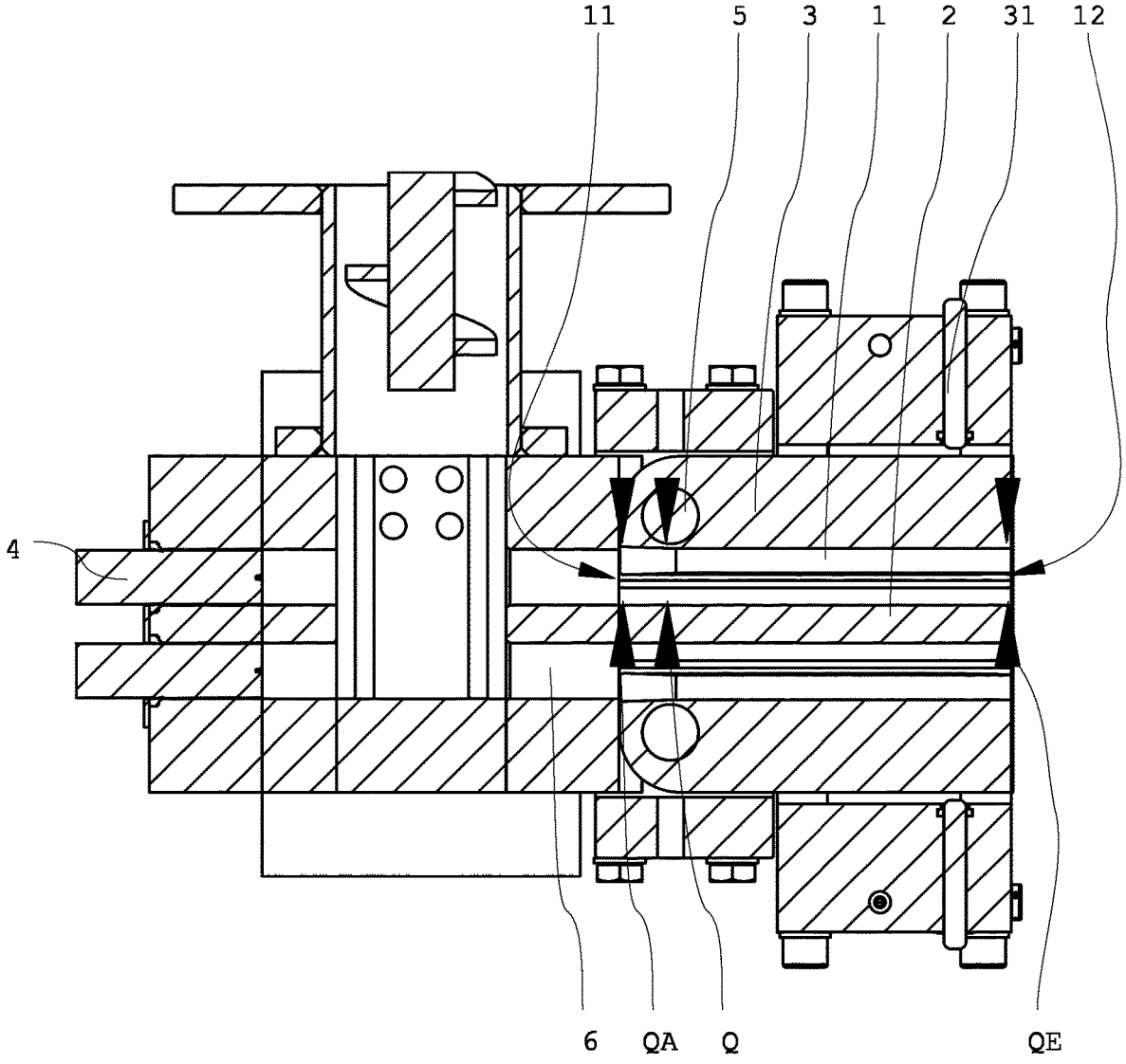
Figure 5A:
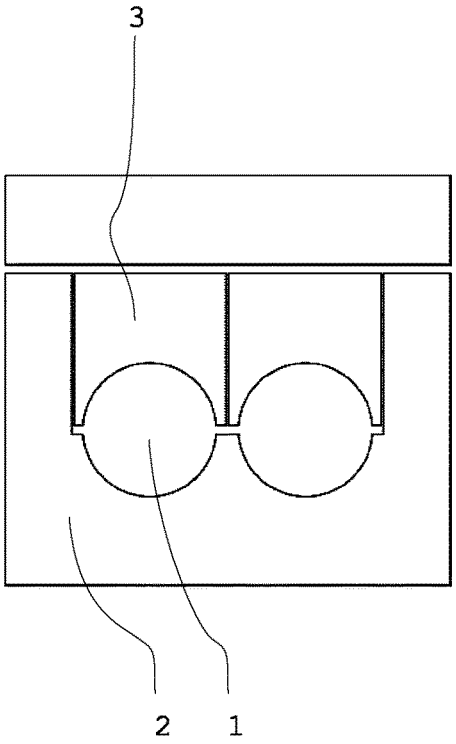
Figure 5B:
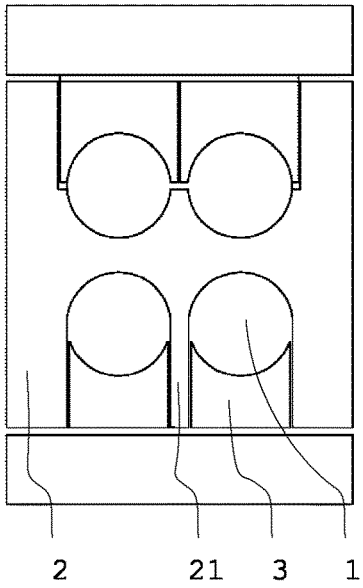
Figure 5C:
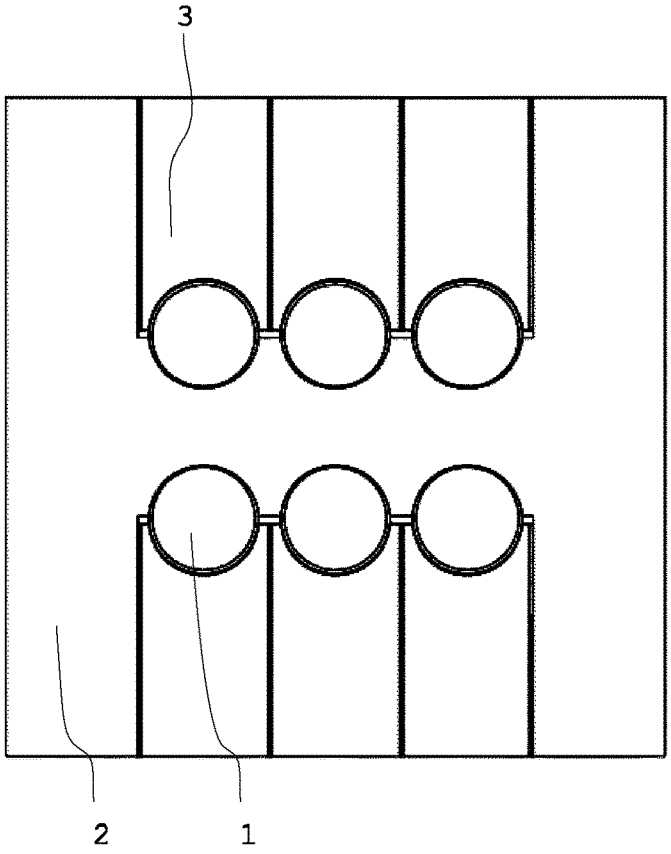

Different embodiments of the present invention will be described using the following figures, showing:

FIG. 1 an apparatus for pressing material to be pressed,

FIG. 2 a part of the apparatus from FIG. 1 having a pressing head,

FIG. 3 a cross section through a pressing channel from FIG. 2 in a perspective view, FIG. 4 the cross section from FIG. 3 in an orthogonal view, and FIGS. 5*a* to 5*c* different embodiments of a pressing head.

FIG. 1 shows an apparatus 200 for pressing material to be pressed S. The apparatus 200 has a funnel 202, for receiving the material to be pressed S. The funnel 202 is connected to a pressing unit which comprises a pressing head 100. The apparatus 200 is seated on a machine frame 201.

FIG. 2 shows a part of the apparatus 200 from FIG. 1. A pressing head 100 is situated within the pressing unit. The pressing unit begins here with a stub 101, to which the filling funnel 202 (FIG. 1) is connected. A screw conveyor 203 (FIG. 3) is situated within said stub 101 and the filling funnel 202. In the figure, one actuating apparatus 30, 30' each is arranged above and below the pressing head 100. The pressing head 100 comprises a common supporting element 2 and six pressing elements 3. Six pressing elements 3 are shown, however, only one is labeled and described for clarity.

The supporting element 2 and the pressing element 3 form the pressing channel 1. Here, three pressing channels 1 are arranged opposite to another three pressing channels 1. Three of the pressing channels each are arranged next to one another. The actuating apparatus 30, 30' interact with the pressing elements 3. In the present case, the pressing head 100 is formed from two side plates, between which the supporting element 2 is arranged. The pressing elements 3 which, together with the supporting element 2, form six pressing channels 1 also belong to the pressing head 100.

FIG. 3 shows a cross section along the longitudinal axis of the pressing channel which is illustrated in FIG. 2. Here, FIG. 3 shows further details of the apparatus according to FIG. 1 which are not shown in FIG. 2. For instance, the machine frame 201, on which the pressing unit having the pressing head 100 is arranged, can be seen in FIG. 3. Here, the conveying direction of the material to be pressed is defined by way of the screw conveyor 203 and the pressing head 100, meaning that the conveying direction is from the screw conveyor 202 in the direction of the pressing head 100 having the outlet openings 12.

For clarity, only some of the same parts (analogously to FIG. 2) are labeled.

The filling funnel, into which the screw conveyor 203 extends, is not visible in FIG. 3. The material to be pressed is added to the filling funnel 202 (see FIG. 1) and is conveyed by way of the screw conveyor 203 into the pre-collecting chamber 204. The material to be pressed is collected in the pre-collecting chamber 204 and is pressed by means of the pressing plungers 4, 4' in the pressing head 100. To this end, the pressing plungers 4, 4' move in the conveying direction into the die 6 and press the material to be pressed through the die 6. The pressing head 100 is arranged downstream of the die 6. The pressing elements 3 and 3' of the pressing head 100 are mounted on rotational axes 5 and 5'. The pressing elements 3 and 3' are mounted on the rotational axes 5 and 5' in such a way that they can move toward and away from the respective actuating apparatus 30, 30'. After a single pressing operation has been carried out multiple times, a collection of individual briquettes is formed within the pressing channel 1, 1' which become ever denser. Said briquettes are held in their position in the pressing channel 1, 1' by way of the pressing elements 3, 3'. As a result of the adjustment of the holding force by way of the actuating elements 31, 31' on the respective pressing elements 3, 3', the reaction force is likewise set to the force of the pressing plungers, and therefore indirectly the pressure on the briquette in the die 6.

FIG. 4 shows the cross section according to FIG. 3 in an orthogonal view. For clarity, only the elements of a single pressing channel 1 are labeled. The pressing channel 1 has an inlet opening 11 and an outlet opening 12. The inlet channel 1 has a cross section QA in the region of the inlet opening 11, and the pressing channel 1 has a cross section QE in the region of the outlet opening 12. The pressing channel 1 is formed by the actuating element 2 and the pressing element 3. The pressing element 3 is mounted rotatably on the rotational axis 5. This results in a regular cross section Q of the pressing channel 1 in the region of the rotational axis 5. When the actuating element 31 then acts on the pressing element 3 in the region of the outlet opening 12, the cross section QE at the outlet opening 12 naturally changes in relation to the cross section QA at the inlet opening 11. The briquette which is shaped by way of the pressing plungers 4 in the die 6 has a diameter which substantially corresponds to the cross section of the die 6. On account of the different nature of the briquettes, however, the elasticity of the briquettes in the cross-sectional direction is different. Once it has been pressed, the briquette is conveyed by way of the following briquette into the pressing channel 1. Said briquette has to be held in the pressing channel 1. The inhomogeneity between the briquettes is significant, but as a result of the adjustment of the pressing element 3 by way of the actuating element 31, a substantially constant holding force can be exerted on the briquettes in the pressing channel 1. Thus, a defined counterforce or reaction force with respect to the pressing plunger 4 is provided within the die.

FIGS. 5*a* to 5*c* show different embodiments of the pressing head. For the sake of clarity, in each case only some of a plurality of identical elements are provided with reference signs.

FIG. 5*a* shows a pressing head having two pressing channels 1 which lie next to one another. Here, the supporting element 2 is formed integrally with a side wall of the pressing head. Pressing channels 1 which are closed off by way of the pressing element 3 are visible within the pressing head. Here, two pressing elements 3 next to one another form the termination of the pressing channel 1 that is open upwardly.

FIG. 5*b* shows an arrangement according to FIG. 5*a*, wherein two pairs of pressing channels 1 are arranged opposite one another. It is conceivable that the two pairs of pressing channels 1 would be configured as described in FIG. 5*a*. Alternatively, it would be conceivable to realise the pressing channels 1 and the pressing element 3 as configured in FIG. 5*b* below. It would be conceivable that the supporting element 2 has an additional web 21 which divides the pressing channels with respect to one another. The pressing elements 3 can be configured only having the width of the diameter of the pressing channel 1, with the result that the pressing elements 3 form a push-in element for the pressing channel 1.

FIG. 5*c* shows a further embodiment of the pressing head, said embodiment corresponding substantially to the embodiment according to FIG. 5*b*, with the difference that three pressing channels 1 each are arranged opposite to one another, wherein three pressing channels 1 being arranged next to one another. Here, the supporting element 2 is likewise configured integrally with side walls of the pressing head. The pressing elements 3 correspond to the embodiment as described in FIG. 5*a*.

The invention claimed is:

1. A pressing head, for an apparatus for pressing material to be pressed, comprising:

at least two pressing channels each with one inlet opening and one outlet opening, each having a longitudinal axis between the inlet opening and the outlet opening, wherein the at least two pressing channels are open along said longitudinal axis, in an orthogonal direction to the longitudinal axis, such that the pressing channel is configured as an open channel connecting the inlet opening and the outlet opening, wherein each pressing channel has a supporting element and one movable pressing element, the pressing element is movable, on one side, wherein a cross section of the pressing channel, at its outlet opening, is changeable relative to a cross section of the pressing channel, at its inlet opening by movement of the pressing element, wherein the pressing element is movably arranged in said open channel.

2. The pressing head according to claim 1, wherein the pressing element is movable on one side relative to the supporting element in a region of the outlet opening.

3. The pressing head according to claim 1, wherein the pressing channels are formed in their cross section substantially in halves by way of the supporting element and the pressing element.

4. The pressing head according to claim 1, wherein the pressing channels have a common supporting element.

5. The pressing head according to claim 4, wherein the common supporting element is configured integrally.

6. The pressing head according to claim 1, wherein the pressing channels are arranged next to one another.

7. The pressing head according to claim 1, wherein the pressing channels are arranged opposite to one another.

8. The pressing head according to claim 1, wherein the pressing element is mounted such that the pressing element can be pivoted about a rotational axis, and the rotational axis is arranged substantially orthogonally with respect to the pressing channel.

9. The pressing head according to claim 8, wherein the rotational axis is fixed with respect to the supporting element in the region of the inlet opening.

10. The pressing head according to claim 8, wherein each pressing element is assigned an actuating element for adjusting the pressing element.

11. The pressing head according to claim 10, wherein each actuating element is independently adjustable.

12. The pressing head according to claim 6, wherein three pressing channels are arranged next to one another.

13. The pressing head according to claim 7, wherein three pressing channels each are arranged opposite to one another.

14. An apparatus for pressing material to be pressed, comprising at least one pressing head according to claim 1.

15. An apparatus for pressing material to be pressed, comprising at least one pressing head according to claim 10.

16. The apparatus according to claim 15, comprising a control apparatus for adjusting the actuating element.

17. The apparatus according to claim 14, wherein each pressing channel is assigned a pressing plunger for pressing the material to be pressed.

18. The apparatus according to claim 17, wherein the pressing plungers are movable by a common cylinder.

19. The apparatus according to claim 14, wherein the apparatus comprises a pre-collecting chamber for receiving and/or for pre-compacting material to be pressed.

* * * * *